United States Patent [19]

Minami et al.

[11] 4,192,724

[45] Mar. 11, 1980

[54] METHOD FOR ELECTROLYZING MOLTEN METAL CHLORIDES

[75] Inventors: Takeshi Minami; Shinichi Toda, both of Tokyo, Japan

[73] Assignee: Chlorine Engineers Corporation, Ltd., Tokyo, Japan

[21] Appl. No.: 950,111

[22] Filed: Oct. 10, 1978

[30] Foreign Application Priority Data

Oct. 26, 1977 [JP] Japan ..... 52/127584

[51] Int. Cl.[2] ..... C25B 11/08; C25C 3/02; C25C 3/04; C25C 3/06

[52] U.S. Cl. ..... 204/67; 204/68; 204/69; 204/70; 204/290 R

[58] Field of Search ..... 204/67, 68, 69, 70, 204/290 R

[56] References Cited

U.S. PATENT DOCUMENTS

| | | | |
|---|---|---|---|
| 4,039,401 | 8/1977 | Yamada et al. | 204/67 |
| 4,098,669 | 7/1978 | de Nora et al. | 204/67 |

FOREIGN PATENT DOCUMENTS

| | | | |
|---|---|---|---|
| 9783 | of 1889 | United Kingdom | 204/67 |

*Primary Examiner*—Howard S. Williams
*Attorney, Agent, or Firm*—Sughrue, Rothwell, Mion, Zinn and Macpeak

[57] ABSTRACT

A method for electrolyzing a molten chloride which comprises electrolyzing a molten bath of a chloride of a metal more base than hydrogen, such as sodium, magnesium, calcium or aluminum, in an electrolytic cell containing an anode and a cathode to form chlorine at the surface of the anode and the metal at the surface of the cathode, wherein the anode comprises an electrically conductive substrate resistant to corrosion by the molten bath of the metal chloride and the electrolysis products thereof and having thereon a coating of a noble metal oxide, and with the electrolysis being carried out in the presence of an oxide or oxychloride of a metal more base than the metal formed at the cathode where the concentration of the oxide or oxychloride of the metal present in the molten bath, expressed as the mole fraction of free oxygen ion, is at least about $1\times10^{-4}$.

4 Claims, No Drawings

METHOD FOR ELECTROLYZING MOLTEN METAL CHLORIDES

BACKGROUND OF THE INVENTION

1. Field of the Invention

This invention relates to an electrolysis method for producing chlorine at the surface of an anode and a metal at the surface of a cathode by electrolyzing a molten metal chloride obtained by melting a chloride of a metal more base than hydrogen such as sodium, magnesium, calcium and aluminum.

2. Description of the Prior Art

Electrolysis of molten sodium chloride (Downs method as disclosed in, for example, U.S. Pat. No. 1,501,756), electrolysis of magnesium chloride as disclosed in, for example, U.S. Pat. Nos. 1,567,318 and 1,921,377, and hightemperature electrolysis of aluminum chloride (Alcoa method as disclosed in, for example, U.S. Pat. No. 3,725,222), for example, are known methods of producing metals by electrolysis of molten metal chlorides.

Conventionally, in these electrolytic methods, carbon is used as an anode and iron or carbon is used as a cathode. The carbon anode is consumed forming CO or $CO_2$ due to an anodic oxidation reaction, and consumption of electric power increases because of the increase in the interelectrode distance. To prevent this, adjustment of the interelectrode distance and replacement of the electrode must be performed periodically. In the Alcoa method for electrolysis of molten aluminum chloride, the consumption of the carbon anode and the formation of sludge are inhibited by limiting the oxide concentration of metal oxide in the molten salt bath to not more than 0.25%, preferably not more than 0.1%, by weight as oxygen thereby to remove the metal oxide in the bath which is a cause of anode consumption, and to maintain the molten salt bath as acidic as possible (e.g., as disclosed in U.S. Pat. No. 3,725,222 corresponding to Japanese Patent Publication No. 15043/77). However, in order to maintain the bath as acidic as possible, the metal oxide must be removed from the bath or the metal oxide content must be reduced, and also the electrolytic cell must be sealed completely so as to prevent entry of moisture and air. The operation and the control of this method are, therefore, complicated.

SUMMARY OF THE INVENTION

An object of this invention is to provide a method for electrolyzing a molten metal chloride, which can be operated in a stable manner over long periods of time, e.g., over a year, without the defects of the prior art described above, by using a dimensionally stable anode and maintaining the electrolytic bath under conditions conducive to the prevention of consumption of the coating layer of the anode.

The present invention is based on the discovery that when an anode having a coating layer of an oxide of a noble metal is used, the solubility of the noble metal oxide forming the coating layer decreases as the basicity of the molten metal salt bath increases (namely, as the free oxygen ion concentration of the bath increases) and, thus, dissolution of the coating layer in the bath can be prevented. This is in contrast to the conventional method of electrolyzing a molten metal salt in which the molten metal salt bath should be maintained acidic to prevent consumption of the carbon anode, and for this purpose, as much of the metal oxide as possible should be removed.

Accordingly, this invention provides a method for electrolyzing a molten chloride which comprises electrolyzing a molten bath of a chloride of a metal more base than hydrogen, such as sodium, magnesium, calcium or aluminum, in an electrolytic cell containing an anode and a cathode to form chlorine at the surface of the anode and the metal at the surface of the cathode, wherein the anode comprises an electrically conductive substrate resistant to corrosion by the molten bath of the metal chloride and the electrolysis products thereof and having thereon a coating of a noble metal oxide, and with the electrolysis being carried out in the presence of an oxide or oxychloride of a metal more base than the metal formed at the cathode where the concentration of the oxide or oxychloride of the metal present in the molten bath, expressed as the mole fraction of free oxygen ion, is at least about $1\times10^{-4}$.

DETAILED DESCRIPTION OF THE INVENTION

The anode used in this invention is composed of a substrate of an electrically conductive material which is resistant to corrosion by the molten metal chloride and the electrolysis products of the molten metal chloride and a coating of a noble metal oxide formed on the substrate of the electrically conductive material. The ceramic material which can be used in this invention is electrically conductive and has good thermal resistance (e.g., about 600° C. or more) and good chemical stability against chlorine at elevated temperature. The electrically conductive substrate can be, for example, a substrate of an electrically conductive ceramic such as a sintered metal oxide containing $SnO_2$, tungsten carbide, boron carbide, silicon carbide, titanium carbide, boron phosphide or the like. The sintered metal oxide containing $SnO_2$ can be formed by sintering $SnO_2$ alone or a mixture of $SnO_2$ as a main component and other metal oxides. Representative examples of other metal oxides which can be used include $Sb_2O_3$, $Fe_2O_3$, $Ta_2O_5$, ZnO, $Cr_2O_3$ and the like. The electrically conductive substrate can also be a ceramic sintered after adding an electrically conductive metal, such as tantalum, riobium, zirconium, etc., to the ceramic material prior to sintering.

Suitable nobel metal oxides which can be used as the coating on the electrically conductive substrate include, for example, oxides of Ru, Rh, Pd, Os, Ir, and Pt. Iridium oxide and ruthenium oxide are especially preferred.

Specific example of cathode materials which can be used in this invention are iron alloys, carbon, graphite, metallic niobium, metallic tantalum, metallic zirconium, niobium alloys, tantalum alloys, zirconium alloys and the like. Usually, an iron cathode or a carbon cathode is used as the cathode employed in this invention.

The oxide or oxychloride of metal added to the molten bath of the metal chloride in the method of this invention should be an oxide of a metal which is more base than the metal to be formed at the anode surface. Examples of useful metal oxides or oxychlorides are the oxides or oxychlorides of alkali metal or alkaline earth metals, such as $Li_2O$, $Na_2O$, $K_2O$, $Rb_2O$, $Cs_2O$, CaO, SrO, BaO, MgOCl or AlOCl. These metal oxides can be used either individually or as a mixture of two or more thereof.

The oxide or oxychloride is selected so that the concentration of the oxide or oxychloride, expressed in terms of the mole fraction of free oxygen ion, is at least about $1\times10^{-4}$. When the mole fraction of the free oxygen ion of the molten salt bath is less than about $1\times10^{-4}$, the basicity of the molten salt bath is low, and the solubility of the noble metal oxide of the anode coating layer in the molten salt bath increases. It is impossible, therefore, to prevent effectively the anode coating layer from dissolving. Theoretically, the upper limit for the mole fraction of the free oxygen ion is the saturated solubility of the oxide or oxychloride employed, since if the saturated solubility exceeds, an oxide or oxychloride precipitate is present in the metal produced. However, the saturated solubility will vary greatly depending upon the kind of baths used, the kind of oxide or oxychloride employed, and the like. In general, a suitable upper limit for the mole fraction of free oxygen ion is such that it does not exceed about $1\times10^{-1}$.

Since, according to this invention, the electrolysis is carried out while the molten salt bath is maintained sufficiently basic by adjusting the mole fraction of the free oxygen ion of the molten salt bath to at least $1\times10^{-4}$, the dissolving of the anode coating layer is prevented, and the electrolysis can be carried out in a stable manner over long periods of time without the need to adjust the interelectrode distance. Furthermore, the metal oxides in the molten salt bath do not need to be removed nor the amount thereof reduced, and the control of the starting material and the operation becomes easy.

Suitable electrolysis conditions which can be used in this invention will vary depending upon the kind of metal chloride electrolyzed. Representative electrolysis conditions which can be used are shown below. These conditions should not be construed as limiting the scope of the present invention.

Electrolysis of NaCl

Bath Composition: NaCl and $CaCl_2$;
Bath Temperature: about 500°–600° C.;
Cell Voltage: about 5–8 V;
Current Density: about 50–100 A/dm$^2$.

Electrolysis of $MgCl_2$

Bath Composition: $MgCl_2$ and at least one of NaCl, $CaCl_2$, KCl or LiCl;
Bath Temperature: about 680°–750° C.;
Cell Voltage: about 6–9 V;
Current Density: about 50–300 A/dm$^2$.

Electrolysis of $CaCl_2$

Bath Composition: $CaCl_2$ and $NH_4Cl$;
Bath Temperature: around about 800° C.;
Cell Voltage: about 15–35 V
Current Density: about 30–120 A/dm$^2$.

Electrolysis of $AlCl_3$

Bath Composition: $AlCl_3$, NaCl and LiCl;
Bath Temperature: about 690°–700° C.;
Cell Voltage: about 3–5 V;
Current Density: about 50–140 A/dm$^2$.

The following Examples are given to illustrate the present invention more specifically. Unless otherwise indicated, all parts, percents, ratios and the like are by weight.

EXAMPLE 1

A molten NaCl.$CaCl_2$ bath was prepared in a conventional Downs electrolytic cell, and CaO was added to the bath to adjust the mole fraction of the free oxygen ion in the bath to at least $1\times10^{-4}$. The molten salt bath was electrolyzed under the conditions described below, and metallic sodium was recovered.

Bath Composition: NaCl 42% by weight; $CaCl_2$ 58% by weight;
Bath Temperature: 590° C.;
Current Density at Cathode: 95 A/dm$^2$;
Current Density at Anode: 50 A/dm$^2$;
Cell Voltate: 6 V;
Anode Substrate: Metal oxide containing $SnO_2$;
Anode Coating Layer: $IrO_2$;
Cathode: Fe.

The electrolysis was operated in a stable manner, and the anode coating layer was not dissolved for one year or more.

EXAMPLE 2

A molten $MgCl_2$.$CaCl_2$.NaCl bath was prepared in an electrolytic cell lined with refractory bricks, and $Na_2O$ was added to the bath to adjust the mole fraction of the free oxygen ion of the bath to at least $9\times10^{-4}$. The molten salt bath was electrolyzed under the following conditions, and magnesium was recovered.

Bath Composition: $MgCl_2$ 20% by weight; $CaCl_2$ 30% by weight; NaCl 50% by weight;
Bath Temperature: 700° C.;
Average Current Density at Cathode: 50 A/dm$^2$;
Average Current Density at Anode: 250 A/dm$^2$;
Cell Voltage: 6 V;
Anode Substrate: Metal oxide containing $SnO_2$;
Anode Coating Layer: $IrO_2$;
Cathode: Fe.

The electrolysis was operated in a stable manner, and the anode coating layer was not dissolved for one year or more.

While the invention has been described in detail and with reference to specific embodiments thereof, it will be apparent to one skilled in the art that various changes and modifications can be made therein without departing from the spirit and scope thereof.

What is claimed is:

1. A method for electrolyzing a molten chloride which comprises electrolyzing a molten bath of a chloride of a metal more base than hydrogen in an electrolytic cell containing an anode and a cathode to form chlorine at the surface of the anode and the metal at the surface of the cathode, wherein the anode comprises an electrically conductive substrate resistant to corrosion by the molten bath of the metal chloride and the electrolysis products thereof and having thereon a coating of a noble metal oxide, and with the electrolysis being carried out in the presence of an oxide or oxychloride of a metal more base than the metal formed at the cathode where the concentration of the oxide or oxychloride of the metal present in the molten bath, expressed as the mole fraction of free oxygen ion, is at least about $1\times10^{-4}$.

2. The method of claim 1, wherein the metal more base than hydrogen is sodium, magnesium, calcium or aluminum.

3. The method of claim 1 or 2, wherein the metal oxide or metal oxychloride present in the molten bath is at least one member selected from the group consisting of $Li_2O$, $Na_2O$, $K_2O$, $Rb_2O$, $Cs_2O$, CaO, SrO, BaO, MgOCl and AlOCl.

4. The method of claim 1, wherein said oxide or oxychloride of the metal present in the molten bath is present in said molten bath up to the saturated solubility of said oxide or said oxychloride in said molten bath.

* * * * *